US009806475B2

(12) United States Patent
Yao et al.

(10) Patent No.: US 9,806,475 B2
(45) Date of Patent: Oct. 31, 2017

(54) WATERPROOF ELECTRICAL CONNECTOR

(71) Applicant: FOXCONN INTERCONNECT TECHNOLOGY LIMITED, Grand Cayman (KY)

(72) Inventors: Tao Yao, Huaian (CN); Yong-Qi Wang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/362,753

(22) Filed: Nov. 28, 2016

(65) Prior Publication Data

US 2017/0155216 A1 Jun. 1, 2017

(30) Foreign Application Priority Data

Nov. 27, 2015 (CN) ..... 2015 1 0840298

(51) Int. Cl.

| | |
|---|---|
| ***H01R 13/658*** | (2011.01) |
| ***H01R 24/60*** | (2011.01) |
| ***H01R 12/72*** | (2011.01) |
| ***H01R 13/52*** | (2006.01) |
| ***H01R 13/6581*** | (2011.01) |
| ***H01R 43/20*** | (2006.01) |
| *H01R 107/00* | (2006.01) |

(52) U.S. Cl.

CPC ..... *H01R 24/60* (2013.01); *H01R 12/722* (2013.01); *H01R 13/5202* (2013.01); *H01R 13/6581* (2013.01); *H01R 43/20* (2013.01); *H01R 2107/00* (2013.01)

(58) Field of Classification Search

CPC ..... H01R 23/7073; H01R 13/658; H01R 23/6873; H01R 13/65802; H01R 13/6658; H01R 23/02

USPC ..... 439/660, 76.1, 607.35, 607.36, 607.4, 439/607.46

See application file for complete search history.

(56) References Cited

U.S. PATENT DOCUMENTS

| | | | | |
|---|---|---|---|---|
| 6,386,919 | B2 * | 5/2002 | Medina | H01R 13/6658 439/607.46 |
| 7,359,208 | B2 * | 4/2008 | Ni | G11B 33/12 174/50.51 |
| 7,407,390 | B1 * | 8/2008 | Ni | G06K 19/07732 361/752 |
| 8,545,273 | B1 * | 10/2013 | Chen | H01R 13/6658 439/660 |
| 2004/0192116 | A1 * | 9/2004 | Matsuo | H05K 1/117 439/660 |
| 2008/0032561 | A1 * | 2/2008 | Hiew | G06K 19/07732 439/660 |

(Continued)

*Primary Examiner* — Gary Paumen
(74) *Attorney, Agent, or Firm* — Wei Te Chung; Ming Chieh Chang

(57) ABSTRACT

An electrical connector having a metallic base insert-molded with an insulative base to initially form a basic unit and successively with an internal PCB inserted in a frame structure of the metallic base to form an intermediate assembly with the reinforced mating portion thereof. An insulator is applied upon a front region of the intermediate assembly to secure the internal PCB and the basic unit together and commonly form a sub-assembly. A die-casting metallic shield encloses the sub-assembly and secured to the metallic base to commonly form the final receptacle connector.

20 Claims, 11 Drawing Sheets

(56) References Cited

U.S. PATENT DOCUMENTS

| | | | | |
|---|---|---|---|---|
| 2009/0247017 | A1* | 10/2009 | Wu | H01R 13/502<br>439/660 |
| 2009/0305570 | A1* | 12/2009 | Farole | H01R 13/6581<br>439/660 |
| 2012/0077390 | A1* | 3/2012 | Tsai | H01R 13/6658<br>439/660 |

* cited by examiner

WATERPROOF ELECTRICAL CONNECTOR

BACKGROUND OF THE INVENTION

1. Field of the Invention

The present invention relates to an electrical connector, and particularly to a USB (Universal Serial Bus) type C connector with a reinforced structure thereof.

2. Description of Related Art

USB type C specification was issue on Aug. 11, 2014, which and hundreds of designs are made based upon. CN 204179284 issued on May 25, 2015 discloses the type C receptacle connector of which the corresponding tongue portion is made by an internal printed circuit board (PCB) for simplifying the complicated insert-molding process of the tiny terminals. Anyhow, attaching an internal PCB to the insulative housing with the mating portion, in a cantilevered manner, having interior strength during mating, compared with the traditional insert-molded terminal module unitarily formed with the tongue portion.

An improved electrical connector having an internal PCB as the tongue portion while having the relatively superior strength thereof, is desired.

SUMMARY OF THE INVENTION

Accordingly, the object of the present invention is to provide an electrical connector having a metallic base insert-molded with an insulative base to initially form a basic unit and successively with an internal PCB inserted in a frame structure of the metallic base to form an intermediate assembly with the reinforced mating portion thereof. An insulator is applied upon a front region of the intermediate assembly to secure the internal PCB and the basic unit and commonly form a sub-assembly. A die-casting metallic shield encloses the sub-assembly and secured to the metallic base to commonly form the final receptacle connector.

Other objects, advantages and novel features of the invention will become more apparent from the following detailed description when taken in conjunction with the accompanying drawings.

DETAILED DESCRIPTION OF THE PREFERRED EMBODIMENT

Figure 1:
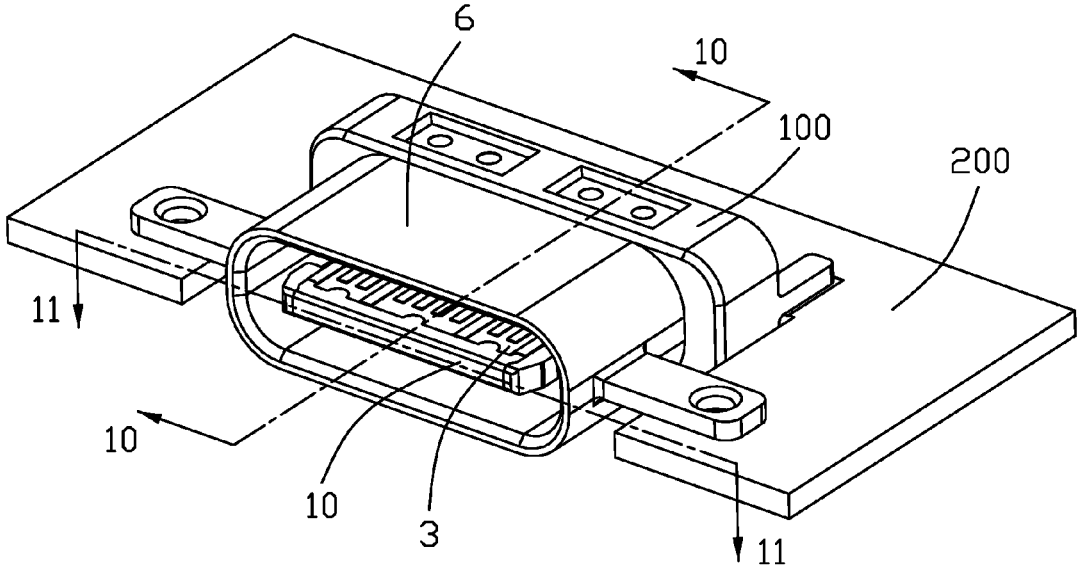
FIG. 1 is a perspective, assembled view of an electrical connector assembly including an electrical connector mounted on the external PCB.
Figure 2:
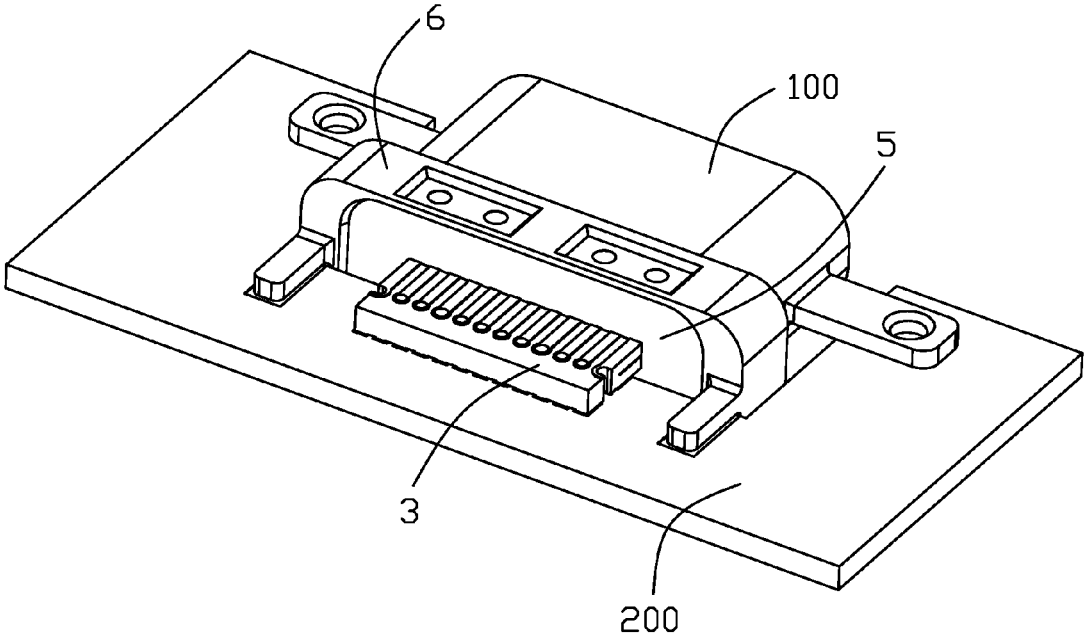
FIG. 2 is another perspective, assembled view of the electrical connector assembly FIG. 1.

Reference will now be made in detail to the preferred embodiment of the present invention. Referring to FIGS. 1 to 11, an electrical connector assembly includes an electrical connector 100 mounted upon an external PCB 200. The electrical connector includes a basic unit 10, an internal PCB 3 with contacting sections 31 on two opposite top and bottom surfaces, an insulator 4, a sealer 5 and a metallic shield 6 enclosing the basic unit 10.

The basic unit 10 includes a metal basic insert-molded with an insulative base 2. The metal base 1 includes a vertical main part 11 and a horizontal holding part 12 forwardly extending from the main part 11 and defining a frame structure thereof. The holding part 12 includes a pair of side arms 121 and a transverse bar 122 linked between front ends of the pair of side arms 121.

Figure 11:
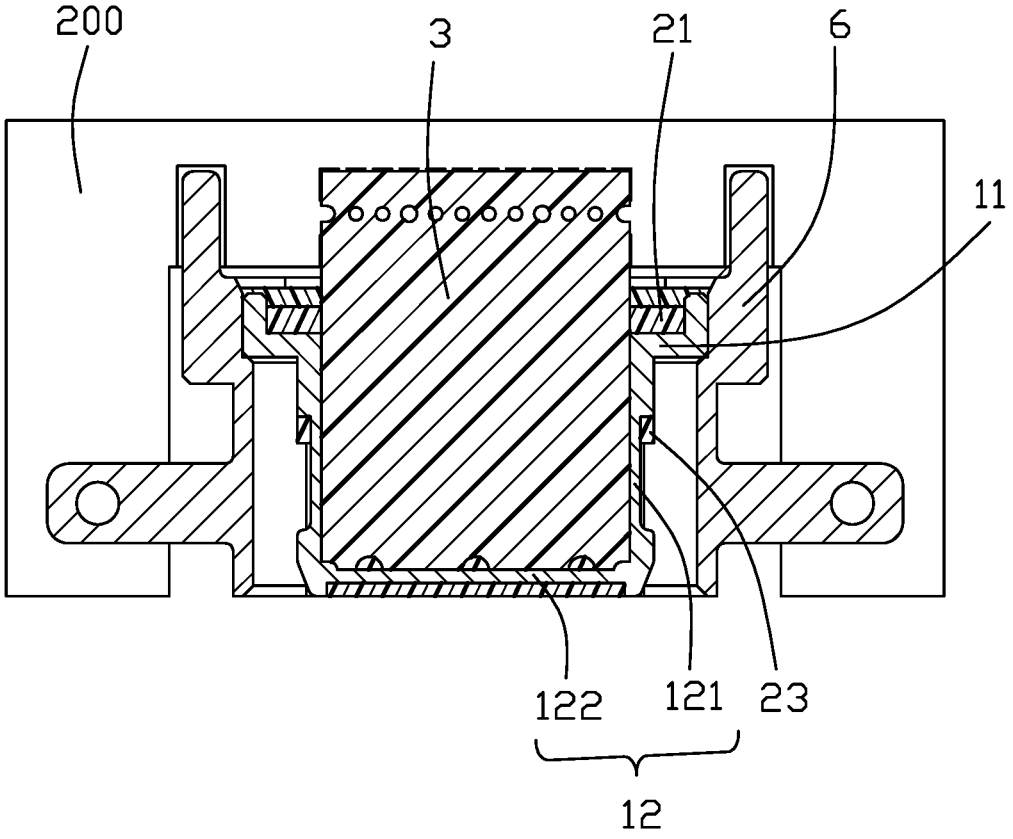
FIG. 11 is another cross-sectional view of the electrical connector of FIG. 1.

The insulative base 2 includes a vertical rear part 21, an extending part 23 forwardly extending from the rear part 21, and an insertion slot 22 extending through the extension part 23 and the rear part 21. As shown in FIG. 11, the main part 11 and the rear portion of the holding part 12 of the metal base 1 are sandwiched by the rear part 21 and the extending part 23. The internal PCB 3 has a shielding layer 32 inside and a plurality of conductive pads 31 on the opposite top and bottom surfaces. The conductive pads 31 on the top surface is reversely symmetrically arranged with regard to those on the bottom surface so as to have the corresponding electrical connector 100 to be mated under a flippable manner. The conductive pad 31 includes a contacting section 311 and a tail section 312. The conductive pad 31 may be replaced with the contact structure or the blade structure.

Figure 3:
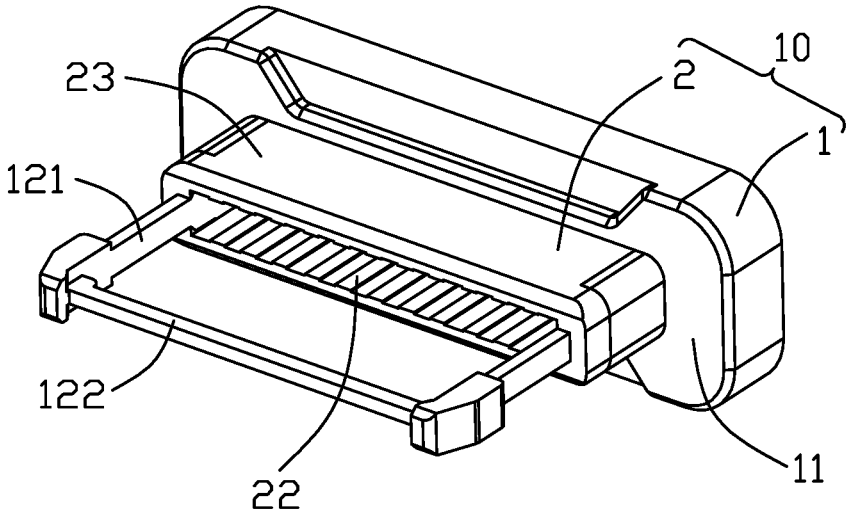
FIG. 3 is a perspective view of the basic unit of the electrical connector of FIG. 1.
Figure 4:
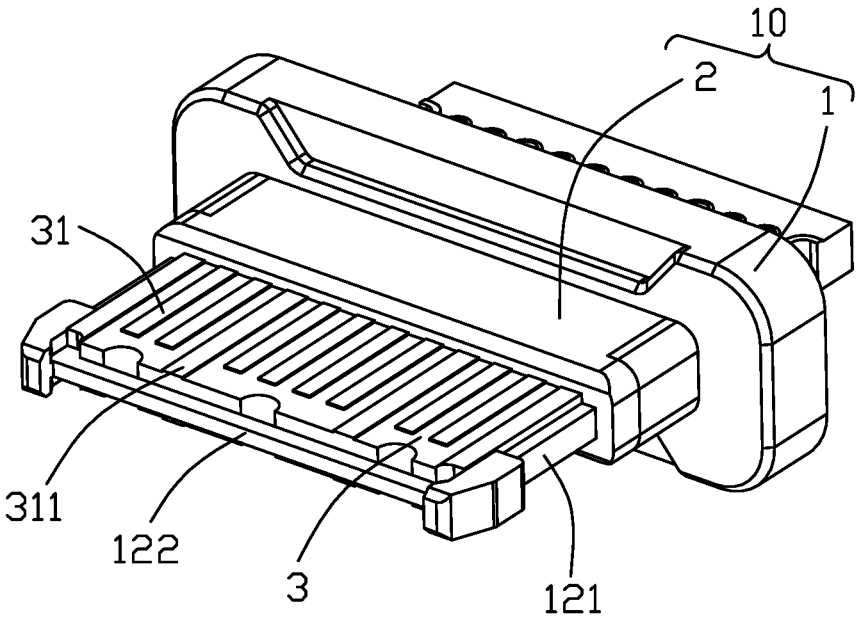
FIG. 4 is a perspective view of the intermediate assembly of the electrical connect of FIG. 1.
Figure 5:
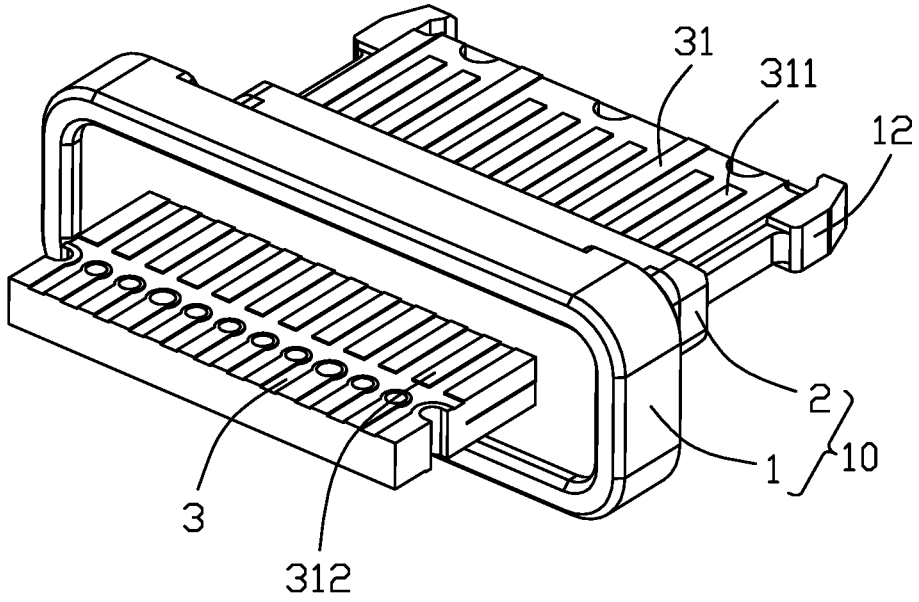
FIG. 5 is another perspective view of the intermediate assembly of the electrical connector FIG. 4.
Figure 6:
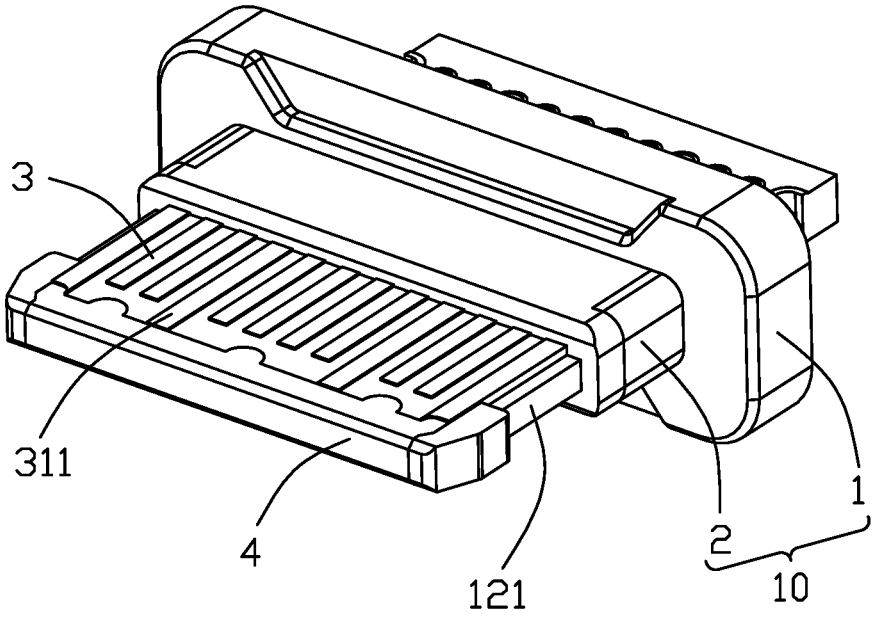
FIG. 6 is a perspective view of the sub-assembly of the electrical connector of FIG. 1.

Referring to FIG. 3, a method of making the electrical connector 100 are as follows. In the molding process, the metal base 1 is formed by the so-call metal injection molding process or the die-casting process, and the insulative base 2 is insert-molded with the metal base 1 to commonly form a basic unit 10. The rear part 21 of the insulative base 2 is insert-molded within the main part 11 of the metal base 1. The extension part 23 of the insulative base 2 and the side arms 121 of the metal base 1 are joined together. Further referring to FIGS. 4 and 5, in forming the PCB 3, the conductive pads 31 are formed on the PCB 3. Further referring to FIGS. 9 and 10, a plurality of through holes 33 extend through the opposite top and bottom surfaces of the PCB with a gold or copper layer coated therein. The conductive pads 31 on the bottom surface result in a group of solder sections on the bottom surface, and the conductive pads on the top result in another group of solder sections on the bottom surface too via said through holes 33. In the insertion process, the PCB 3 is inserted into the insertion slot 22 to form an intermediate assembly wherein the middle portion of the PCB 3 is received within the insertion slot 22 after assembled, the front portion of the PCB 3 is held within the holding part 12 among the two side arms 121 and the transverse bar 122, and a rear portion of the PCB 3 extends rearwardly out of the insertion slot 22. The contacting sections 311 of conductive pads 31 are exposed in front of the insertion slot 22, and the tail sections 312 of the conductive pads 31 are rearwardly exposed outside of the insertion slot 22.

Figure 7:
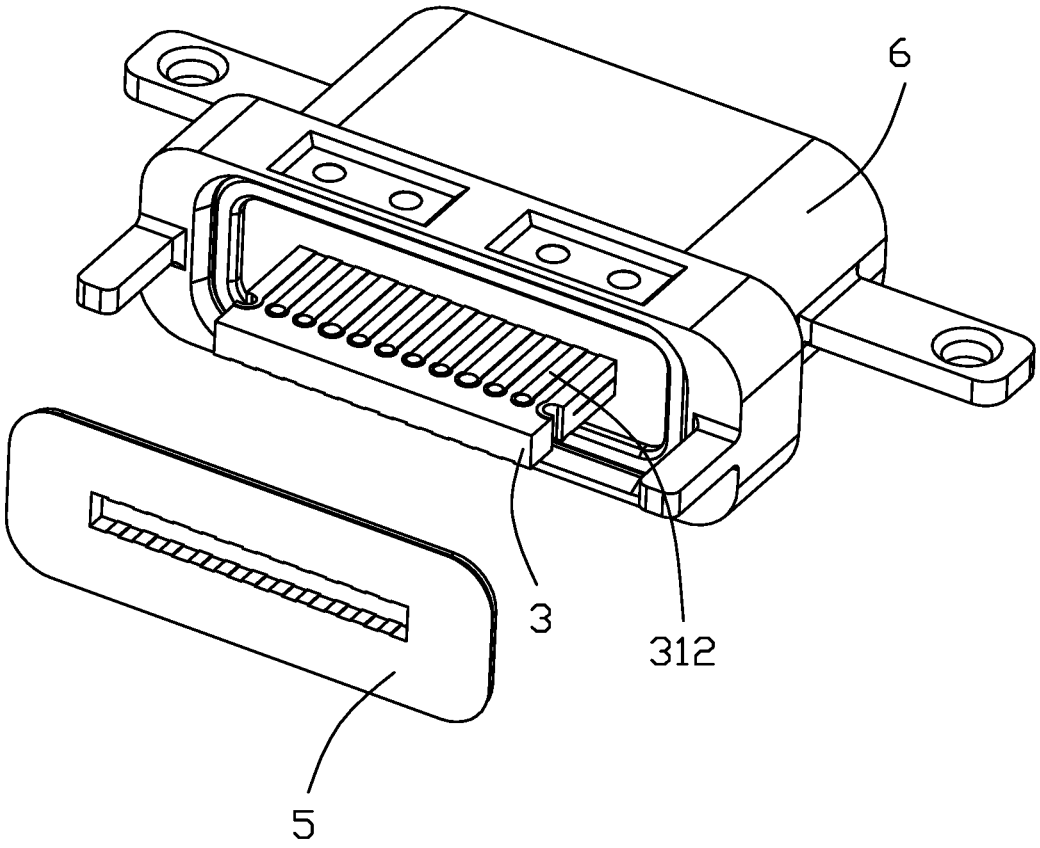
FIG. 7 is an exploded perspective of the electrical connector of FIG. 1.
Figure 8:
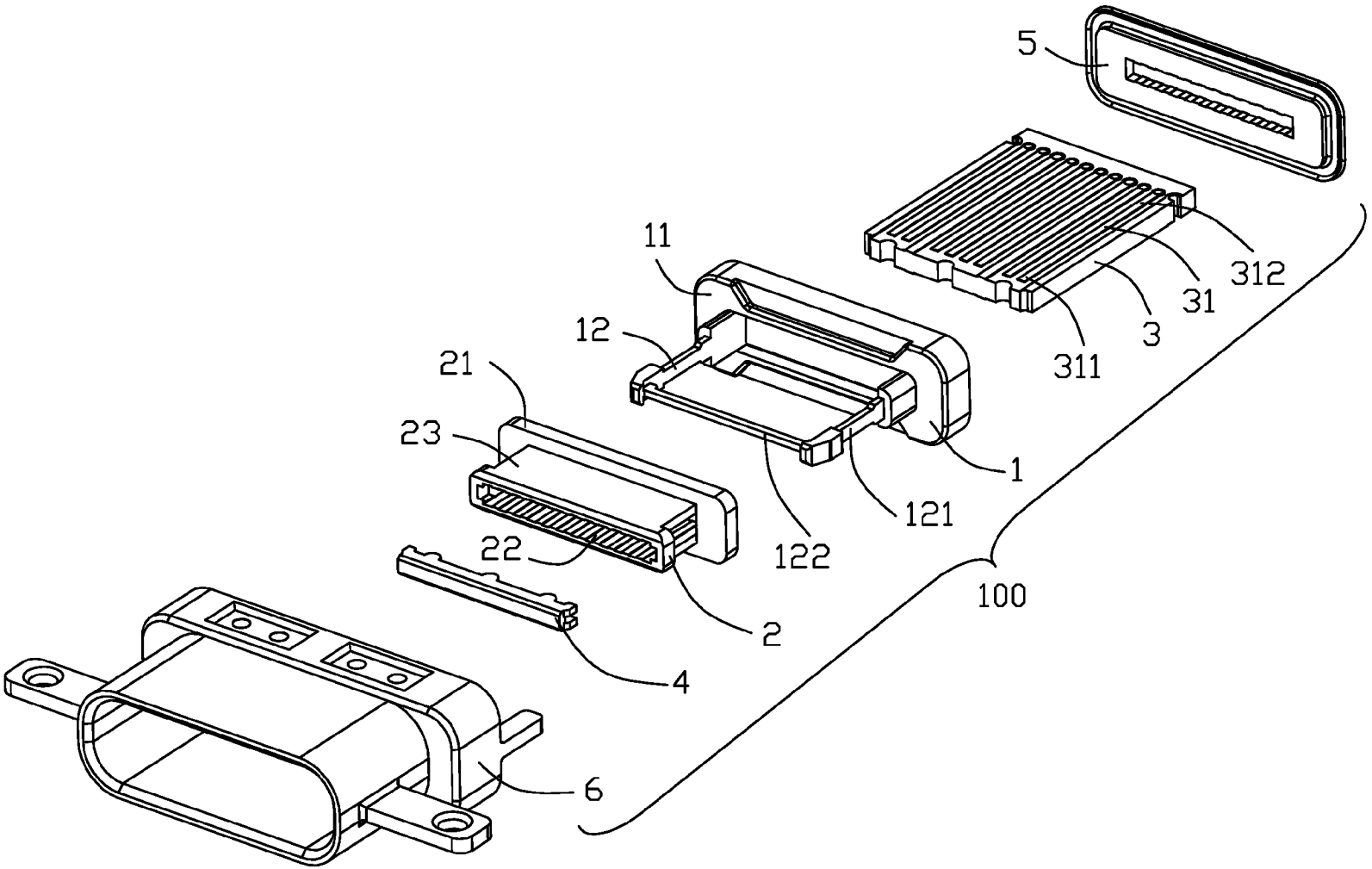
FIG. 8 is a further exploded perspective of the electrical connector of FIG. 7.
Figure 9:
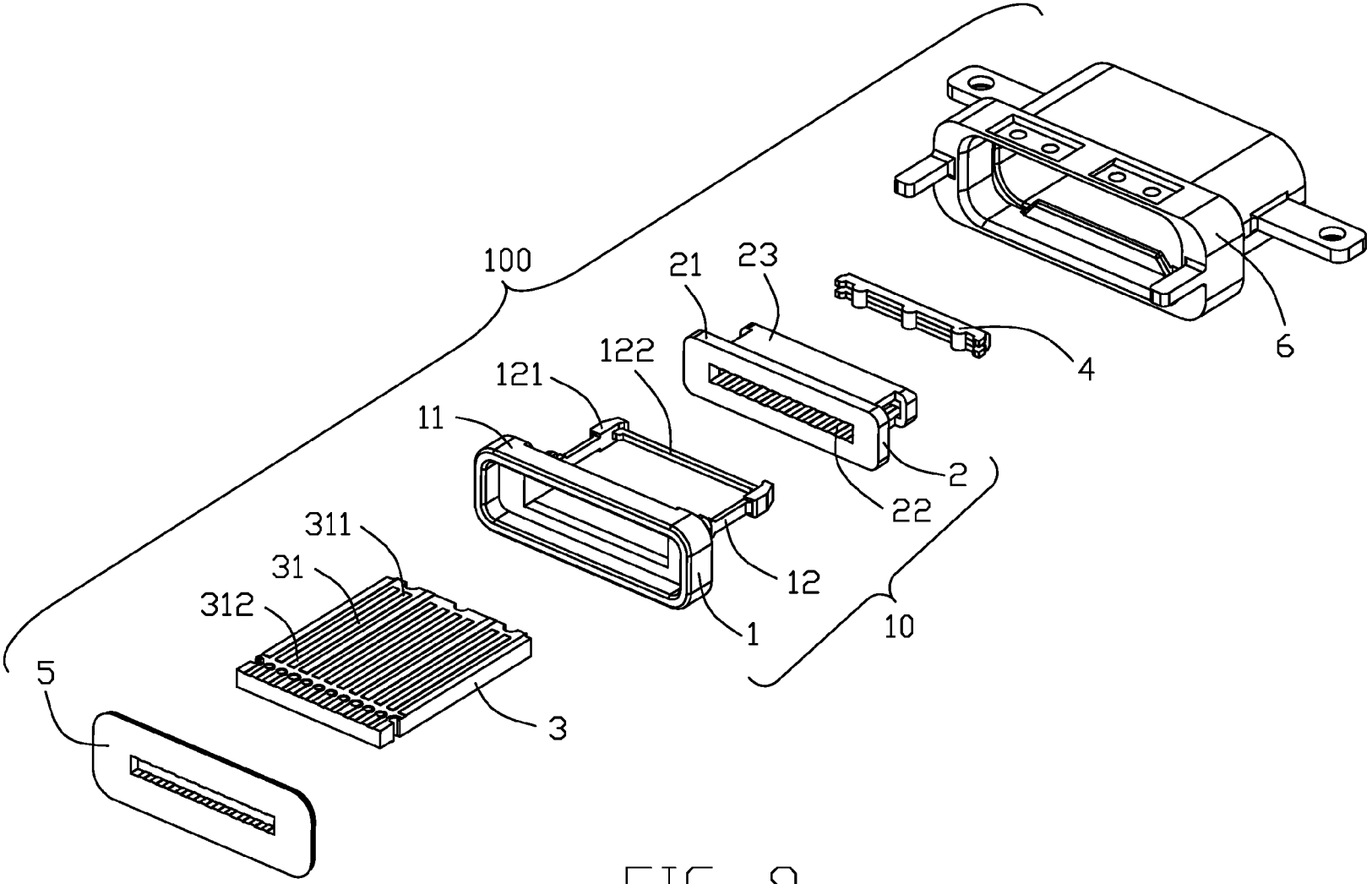
FIG. 9 is an exploded perspective of the electrical connector of FIG. 8.
Figure 10:
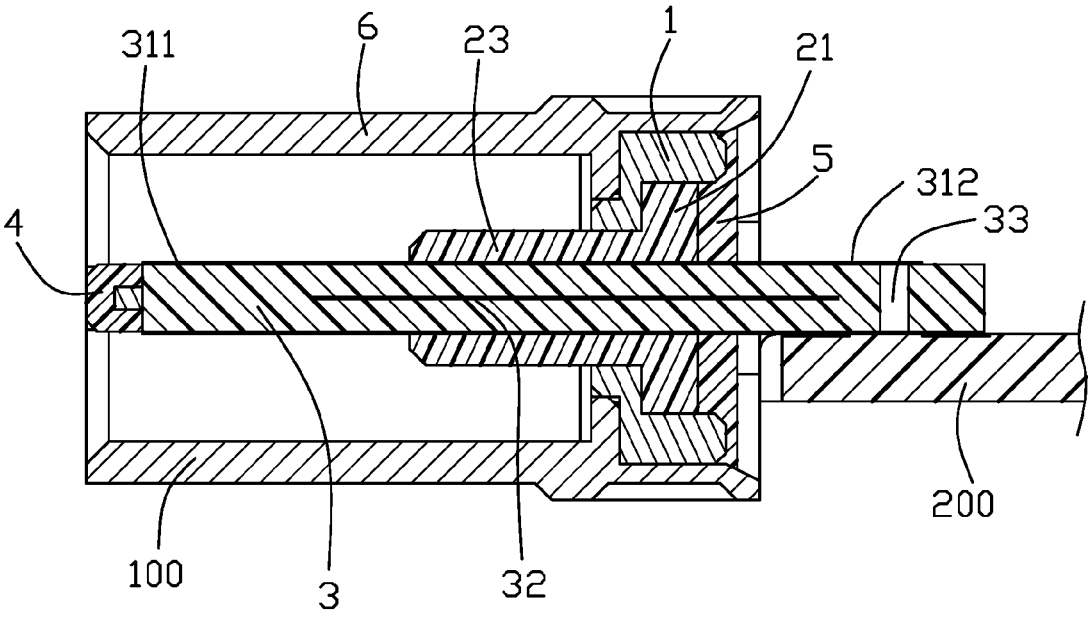
FIG. 10 is a cross-sectional view of the electrical connector of FIG. 1.

The insulator 4 is insert-molded upon a front edge portion of the intermediate assembly including a front region of the PCB 3, the transverse bar 122 and optionally the front ends of the side arms 121 to form a sub-assembly. Referring to FIG. 7, the die-casting metallic shield 6 is assembled upon the metal base 1 of the basic unit 10 of the sub-assembly via welding. A sealing process is performed by applying the sealer 5 upon the rear region of the shield 6 and behind the basic unit 10 so as to seal the gaps between the basic unit 10 and the shield 6, the gaps between the PCB 3 and the insulative base 2. In the soldering process, the tail sections 312 are soldered upon the external PCB 200.

In brief, in the invention on one hand, the basic unit 10 is made by insert-molding the insulative base 2 upon the metal base 1, thus being relatively stronger compared with the traditional simple insulative housing. On the other hand, the holding part 12 forms a frame structure to intimately contact the corresponding edges of the PCB 3 wherein the PCB is further integrally formed with the basic unit 10 via the insulator 4, thus being relative stronger to resist the forces upon mating. Through the through holes 33 cooperating with the tail sections 312 on the top surface of the PCB 3, the bottom surface may form two rows of soldering regions for soldering to the external PCB 200 conveniently. Notably, in this embodiment, the front edge region of the PCB e forms a plurality of notches (not labeled) in which the insulator 4 is filled. Alternately, such curved notches may be replaced with the dovetailed notches for better retention between the PCB 3 and the basic unit 10 in the front-to-back direction. Similarly, the notch may be formed in the lateral sides of the PCB 3 and the front ends of the side arms are thinned like the transverse bar 122 to allow the insulator 4 to enter the notch in the lateral side for better retention between the PCB 3 and the basic unit 10. Another feasible way to retain the internal PCB 3 with regard to the basic unit 10 along the front-to-back direction is to provide a resilient latch around a rear portion of the insulative base to latch within a corresponding notch in a rear section of the lateral side of the PCB 3. Notably, the aforementioned soldering regions on the rear portion of the internal PCB 3 is also adapted to be connected to the wires rather than to the external PCB.

However, the disclosure is illustrative only, changes may be made in detail, especially in matter of shape, size, and arrangement of sections within the principles of the invention.

What is claimed is:

1. An electrical connector comprising:

an insulative base insert-molded upon a metallic base to form a basic unit, said metal base including a holding part including a pair of side arms linked with a transverse bar therebetween, said insulative base forming an insertion slot;

an internal PCB (printed circuit board) extending through said insertion slot of the basic unit and received in said holding part to form an intermediate assembly;

an insulator applied upon a front edge region of the intermediate assembly to form a sub-assembly.

2. The electrical connector as claimed in claim 1, further including a die-casting metallic shield enclosing said sub-assembly.

3. The electrical connector as claimed in claim 2, further including a sealer within the shield and behind a rear side of the basic unit so as to seal not only gaps between the shield and the metal base of the basic unit but also gaps between the internal PCB and the insulative base of the basic unit.

4. The electrical connector as claimed in claim 1, wherein the insulator extends through a corresponding notch in the internal PCB in a vertical direction to secure said PCB.

5. The electrical connector as claimed in claim 1, wherein said metal base further includes a vertical main part behind the holding part, and the insulative base includes a vertical rear part and an extending part extending forwardly from the rear part and cooperating with the rear part to sandwich the main part therebetween in a front-to-back direction.

6. The electrical connector as claimed in claim 1, wherein the transverse bar is thinner than the side arms in a vertical direction so as to be grasped by the insulator.

7. A method of making an electrical connector comprising steps of:

providing a basic unit with an insulative base integrally formed with a metal base via an insert-molding process wherein the metal base includes a holding part having at least a pair of forwardly extending side arms, and said insulative base includes an insertion slot;

forwardly inserting an internal PCB (printed circuit board) into the insertion slot to form an intermediate assembly and have a front portion of the internal PCB received within the holding part; and applying an insulator upon a front edge portion of the intermediate assembly to form a sub-assembly.

8. The method as claimed in claim 7, further including a step of assembling a die-casting metallic shield upon said sub-assembly.

9. The method as claimed in claim 8, wherein said metallic shield is welded to the metal base.

10. The method as claimed in claim 8, further including a step of applying a sealer to a rear region of the shield and behind the basic unit to seal not only gaps between the shield and the metal base of the basic unit but also gaps between the internal PCB and the insulative base of the basic unit.

11. The method as claimed in claim 8, wherein said metal base further includes a vertical main part behind the holding part, and the insulative base includes a vertical rear part an extending part extending forwardly from the rear part and cooperating with the rear part to sandwich the main part therebetween in a front-to-back direction.

12. The method as claimed in claim 8, wherein said holding part further includes a transverse bar linked between front ends of said pair of side arms and thinner than the side arms in a vertical direction to be enclosing within the insulator, and said internal PCB is located behind the transverse bar.

13. The method as claimed in claim 8, wherein said insulator fills a corresponding notch formed in the internal PCB along a vertical direction to secure said internal PCB in position.

14. An electrical connector comprising:

a basic unit including an insulative base integrally formed with a metallic base, said insulative base forming an insertion slot and said metallic base forming a holding part with a frame structure including at least a pair of side arms;

an internal PCB (printed circuit board) forwardly extending through the insertion slot with thereof a front region confined by the holding part to commonly form an intermediate assembly;

an insulator applied upon a front edge region of the intermediate assembly to form a sub-assembly wherein the side arms are exposed outwardly and transversely to an exterior; and a metallic shield assembled upon and enclosing the sub-assembly.

15. The electrical connector as claimed in claim 14, wherein a sealer is applied behind the basic unit to seal not only gaps between the shield and the metal base but also gaps between the internal PCB and the insulative base.

16. The electrical connector as claimed in claim 14, wherein the shield is welded to the metal base.

17. The electrical connector as claimed in claim 14, wherein said metal base includes a vertical main part from which the holding part forwardly extends, and said insulative base includes a vertical rear part from which an extending part forwardly extends, said main part being sandwiched between the rear part and the extending part in a front-to-back direction.

18. The electrical connector as claimed in claim 14, wherein the internal PCB forms at least one notch filled by the insulator.

19. The electrical connector as claimed in claim 18, wherein said notch is located in a front edge region of the internal PCB.

20. The electrical connector as claimed in claim 19, further including a transverse bar linked between front ends of said pair of side arms, wherein said transverse bar is thinner than the side arms and enclosed within and grasped by the insulator, and said internal PCB is located behind the transverse bar.

* * * * *